US006602836B2

(12) United States Patent
Chiou et al.

(10) Patent No.: US 6,602,836 B2
(45) Date of Patent: Aug. 5, 2003

(54) MACHINE DISHWASHING COMPOSITIONS CONTAINING CATIONIC BLEACHING AGENTS AND WATER-SOLUBLE POLYMERS INCORPORATING CATIONIC GROUPS

(75) Inventors: Catherine Chiou, Saddle Brook, NJ (US); Naresh Dhirajlal Ghatlia, Rutherford, NJ (US); John Richard Nicholson, Ramsey, NJ (US); Bozena Marianna Piatek, Cedar Grove, NJ (US)

(73) Assignee: Unilever Home & Personal Care USA, a division of Conopco, Inc., Greenwich, CT (US)

( * ) Notice: Subject to any disclaimer, the term of this patent is extended or adjusted under 35 U.S.C. 154(b) by 143 days.

(21) Appl. No.: 09/829,580

(22) Filed: Apr. 10, 2001

(65) Prior Publication Data

US 2003/0073596 A1 Apr. 17, 2003

Related U.S. Application Data

(60) Provisional application No. 60/203,410, filed on May 11, 2000.

(51) Int. Cl.[7] ..... C11D 3/22; C11D 3/395

(52) U.S. Cl. ..... 510/220; 510/219; 510/237; 510/375

(58) Field of Search ..... 510/221, 220, 510/227, 219, 237, 375

(56) References Cited

U.S. PATENT DOCUMENTS

| | | | |
|---|---|---|---|
| 4,728,455 | A | 3/1988 | Rerek |
| 5,106,528 | A | 4/1992 | Francis et al. |
| 5,114,606 | A | 5/1992 | Van Vliet et al. |
| 5,153,161 | A | 10/1992 | Kerschner et al. |
| 5,194,416 | A | 3/1993 | Jureller et al. |
| 5,227,084 | A | 7/1993 | Martens et al. |
| 5,236,616 | A | 8/1993 | Oakes et al. |
| 5,244,594 | A | 9/1993 | Favre et al. |
| 5,246,612 | A | 9/1993 | Van Dijk et al. |
| 5,246,621 | A | 9/1993 | Favre et al. |
| 5,256,779 | A | 10/1993 | Kerschner et al. |
| 5,274,147 | A | 12/1993 | Kerschner et al. |
| 5,280,117 | A | 1/1994 | Kerschner et al. |
| 5,281,361 | A | 1/1994 | Adams et al. |
| 5,292,447 | A | 3/1994 | Venturello et al. |
| 5,294,362 | A | 3/1994 | Venturello et al. |
| 5,308,532 | A | 5/1994 | Adler et al. |
| 5,360,568 | A | 11/1994 | Madison et al. |
| 5,360,569 | A | 11/1994 | Madison et al. |
| 5,370,826 | A | 12/1994 | Madison et al. |
| 5,422,028 | A | 6/1995 | Oakes et al. |
| 5,520,835 | A | 5/1996 | Sivik et al. |
| 5,559,261 | A | 9/1996 | Sivik |
| 5,599,781 | A | 2/1997 | Haeggberg et al. |
| 5,695,575 | A | 12/1997 | Angevaare et al. |
| 5,705,465 | A | 1/1998 | Angevaare et al. |
| 5,902,781 | A | 5/1999 | Painter |
| 5,904,161 | A | 5/1999 | Rai et al. |
| 5,908,820 | A | 6/1999 | Oakes et al. |
| 5,981,456 | A | 11/1999 | Tartakovsky et al. |
| 6,020,294 | A | 2/2000 | Getty et al. |

FOREIGN PATENT DOCUMENTS

| | | |
|---|---|---|
| EP | 0303520 | 2/1989 |
| EP | 0399584 | 11/1990 |
| EP | 0560519 | 9/1993 |
| EP | 0699745 | 3/1996 |
| WO | 96/20996 | 7/1996 |
| WO | 96/23859 | 8/1996 |
| WO | 96/23860 | 8/1996 |
| WO | 96/23861 | 8/1996 |
| WO | 99/50382 | 10/1999 |
| WO | 99/63038 | 12/1999 |
| WO | 00/23646 | 4/2000 |
| WO | 01/05923 | 1/2001 |

OTHER PUBLICATIONS

International Search Report Application No. PCT/EP01/05014 mailed Oct. 8, 2001.

*Primary Examiner*—Charles Boyer
*Assistant Examiner*—John M. Petruncio
(74) *Attorney, Agent, or Firm*—Ronald A. Koatz

(57) ABSTRACT

Detergent formulations containing cationic bleaching agents and water-soluble polymers having cationic groups improve tea stain removal in machine dishwashing applications.

15 Claims, No Drawings

MACHINE DISHWASHING COMPOSITIONS CONTAINING CATIONIC BLEACHING AGENTS AND WATER-SOLUBLE POLYMERS INCORPORATING CATIONIC GROUPS

This application claims the benefit of provisional application No. 60/203,410, filed May 11, 2000.

FIELD OF THE DISCLOSURE

The present disclosure relates to detergent compositions that contain both cationic bleaching agents and polymers incorporating cationic groups.

BACKGROUND

Cationic polymers are known to deliver glass corrosion protection and color protection benefits in automatic dishwashing formulations. It is believed that the polymer forms a coating on the glass surface, protecting the surface from attack by other ingredients within the formulation. Examples of cationic polymers that reduce corrosion of dishware in an automatic dishwashing machine, include those described in U.S. Pat. No. 5,981,456 (Unilever), the contents of which are incorporated herein by reference. Amphoteric polymers (containing both cationic and anionic groups within the same structure) are known to provide anti-spotting benefits. It is believed that amphoterics suspend proteinaceous soil fragments that are thought to be responsible for spots. In addition, the cationic portion of the amphoteric polymer structure can cause the polymer to be adsorbed onto glass surfaces, thereby providing a sheeting action to the water and contributing to spotless glasses. Examples of amphoteric polymers include water-soluble aminoacryloyl-containing polymers, such those described in U.S. Pat. No. 5,308,532 and EP 0 560 519 B1 (both of Rohm and Haas Company).

Bleaching compositions and bleach systems are also well known and provide desired cleaning properties in many commercial detergents. Chlorine and N,N,N',N'-tetraacetylethylenediamine (TAED)/perborate, for example, are well known for their bleaching properties. Cationic bleach systems that include cationic nitrites in the presence of peroxide are also known (see, for example, U.S. Pat. Nos. 5,236,616 and 5,281,361, EP 0 303 520 B1 and WO 99/63038, the contents of which are incorporated herein by reference). Other known cationic group containing organic bleach activators or bleach catalysts include, for example, cholyl(4-sulfophenyl)carbonate (CSPC, see, for example, U.S. Pat. No. 5,106,528 and EP 399,584 B1), quaternary imine salts (e.g. N-methyl-3,4-dihydroisoquinolinium p-toluenesulfonate, U.S. Pat. Nos. 5,360,568, 5,360,569 and 5,370,826). Several different types of cationic peracid bleach activators have been disclosed in EP 0 699 745, U.S. Pat. Nos. 5,599,781, 5,520,835, the contents of which are incorporated herein by reference. Cationic peroxyacids, such as those described in U.S. Pat. Nos. 5,908,820, 5,422,028, 5,294,362 and 5,292,447, have also shown good bleaching activity over a wide range of pH conditions.

Transition metal-containing bleach catalysts such as $[Mn^{IV}_2(\mu\text{-}O)_3(Me_3TACN)_2](PF_6)_2$ (U.S. Pat. Nos. 4,728,455, 5,114,606, 5,153,161, 5,194,416, 5,227,084, 5,244,594, 5,246,612, 5,246,621, 5,256,779, 5,274,147, 5,280,117), $[Fe^{II}(MeN4py)(MeCN)](ClO_4)_2$ (EP 0 909 809) and $[Co^{III}(NH_3)_5(OAc)](OAc)_2$ (U.S. Pat. No. 5,559,261, WO 96/23859, WO 96/23860, WO 96/23861), also exhibit cationic character under typical wash conditions.

In machine dishwashing applications, removal of bleachable stains, e.g. tea stains, is a particularly desirable property. Incomplete removal of such stains is readily noticeable and can lead to consumer dissatisfaction with the responsible detergent.

During the course of investigating various machine dishwashing compositions, it was unexpectedly discovered that the addition of polymers containing cationic monomeric units to formulations having known bleaching systems negatively affected tea stain removal. For example, when water-soluble amphoteric polymers, such as quaternized aminoacryloyl-containing polymers, were added to formulations containing TAED/perborate, the ability of the formulation to remove tea stains was significantly reduced.

Therefore, it was discovered that there is a need for machine dishwashing formulations that have both bleach and sheeting/anti-spotting ingredients or ingredients that provide color protection and/or corrosion prevention (i.e. care enhancing) properties, wherein the formulation does not negatively impact the ability of the bleach to reduce tea stains.

SUMMARY

It has been found that machine dishwashing detergent formulations containing polymers having cationic monomeric units in combination with a bleaching agent can provide the desired bleaching benefit if the beaching agent also has a cationic group. A preferred formulation has a bleach system having at least one cationic group and a polymer having at least one monomer unit having a cationic charge over a portion of the pH range 2–11. Detergent formulations that do not combine a cationic polymer portion with a cationic bleach exhibit the discovered undesirable bleaching properties.

DETAILED DESCRIPTION

The present disclosure primarily relates to detergent formulations that are suitable for use in machine dishwashers. The formulations disclosed herein can be powder, tablet, block, gel, liquid, solid or semi-solid.

Suitable formulations generally include one or more of the following ingredients: both phosphate and nonphosphate (e.g. sodium citrate) builders; pH buffering agents; silicates; bleaches and bleaching systems including bleach catalysts; surfactants; enzymes; enzyme stabilization systems; thickeners; stabilizers and/or co-structures; fillers; defoamers; soil suspending agents; anti-redeposition agents; anti-corrosion agents; ingredients to enhance decor care; anti-tarnish agents; rinse aids; colorants; perfumes; and other known functional additives. More specific examples of the above and other known machine dish detergent ingredients are disclosed, for example, in U.S. Pat. Nos. 5,695,575, 5,705,465, 5,902,781, 5,904,161 and 6,020,294, the contents of which are incorporated herein by reference.

Suitable phosphate and non-phosphate formulations in accordance with the present disclosure include the following:

TABLE A

Formulation Ranges

| Component | Wt % |
|---|---|
| Sodium Carbonate | 0–50 |
| Sodium Bicarbonate | 0–30 |
| Sodium Disilicate | 0–40 |
| Sodium Citrate | 0–70 |
| Sodium Tripolyphospahte | 0–70 |
| Sodium Perborate or percarbonate | 2–25 |
| Bleach Activator/Catalyst | 0.05–5 |
| Anti-tarnishing agent | 0–2 |

TABLE A-continued

| Formulation Ranges | |
|---|---|
| Component | Wt % |
| Polymer | 0–10 |
| Anti-scalant | 0–5 |
| Amylase | 0–10 |
| Protease | 0–5 |
| Nonionic Surfactant | 0–5 |
| Perfume | 0–0.5 |
| Sodium Sulfate | Balance |

In all examples, the following base formulation was used:

TABLE B

| Base Formulation | |
|---|---|
| Components | % wt |
| Sodium Tripolyphosphate | 60.6 |
| Sodium Disilicate | 19.4 |
| Sodium Perborate Monohydrate | 9.0 |
| Amylase | 1.7 |
| Protease | 2.7 |
| Dispersant Polymer | 3.3 |
| Anti-scalant | 1.1 |
| Anti-Tarnishing Agent | 0.05 |

For simplicity, Table C sets forth several abbreviations used in the text of the present disclosure.

TABLE C

| Abbreviations used in the text | |
|---|---|
| APTAC | (3-Acrylamidopropyl) trimethylammonium chloride |
| Cationic Nitrile | Cyanomethyl trimethylammonium methylsulfate |
| CSPC | Cholyl(4-sulphophenyl)carbonate |
| DMDAAC | Dimethyl diallyl ammonium chloride |
| Imine Quat | N-methyl-3,4-dihydroisoquinolinium p-toluenesulfonate |
| KMPS | Potassium monopersulfate, triple salt |
| MeN4py | N,N-bis(pyridin-2-yl-methyl)-1, 1-bis(pyridin-2-yl)-1-aminoethane |
| $Me_3TACN$ | 1,4,7-trimethyl-1,4,7-triazacyclononane |
| OAc | Acetate |
| PC2 Polymer | Copolymer of acrylic acid and APTAC |
| P-15 | Sodium benzoyloxybenzene sulfonate |
| SNOBS | Sodium nonanoyloxybenzene sulfonate |
| TAED | Tetraacetylethylenediamine |

Experimental Conditions

All dishwashing machine tests were carried out using a Miele G656 dishwasher setting at the 55° Normal program, which accommodated main wash, pre-rinse and final rinse cycles. Water hardness was adjusted to contain 300 ppm of total hardness ($Ca^{2+}$:$Mg^{2+}$=4:1, expressed as $CaCO_3$) and 320 ppm of temporary hardness expressed as sodium bicarbonate (i.e. 300/320 ppm water hardness). Soil load includes 20 g of ASTM standard food soil (a 4:1 wt/wt ratio of margarine/powdered milk) spread on the dishwasher door and 5 g of raw egg yolk dosed at the dispenser cup opening during the main wash cycle. In addition, 6 tea stained cups, 6 drinking glasses, 2 Tupperware containers, 1 melamine plate, 1 Teflon-coated frying pan and 16 clean plates were also present in the dishwasher to mimic the actual washing conditions.

In a typical machine test, 18 g of the base formulation (Table B, excluding bleach activator or glass appearance/care enhancing polymers) was used, unless noted otherwise. Bleach activator and/or glass appearance/care enhancing polymers were introduced separately at the dispenser cup opening during the main wash cycle.

At the end of each test, tea cups were scores based on area covered by and intensity of residual tea stain, expressed on a 0 to 5 scale, 0 being completely cleaned. Drinking glasses and plastic ware were also visually assessed and scored according to extent of spotting and filming. Both spotting and filming scores were recorded based on area covered by and intensity of spots/film, and also expressed on a 0 to 4 scale for spotting and a 0 to 5 scale for filming, 0 being completely free of spots or film.

Examples 1–3 detail the negative effect on tea stain removal caused by an amphoteric polymer (PC2 Polymer) in the presence of a neutral or anionically charged bleach activator, such as TAED, SNOBS and P-15.

Examples 4–6 illustrate the beneficial effect of peroxyacid bleach incorporating a cationic group into an automatic dishwashing detergent formulation that contains a glass appearance improving polymer.

Examples 7–9 demonstrate the synergistic effect of combining transition metal bleaching systems that are cationically charged, and PC2 Polymer, giving both tea stain removal and glassware despotting benefit.

Example 10 further teaches the effect of cationic polymer (e.g. Celquat H-100) against tea stain removal. Similar to previous examples, the deficiency in tea stain removal caused by the cationic polymer can be mitigated by the use of a cationic peroxyacid bleaching agent (e.g. cationic nitrile) or a transition metal-containing bleach catalyst.

Example 11 expands the use of a dishware care-enhancing cationic polymer (Merquat 3331). The combination of such polymer and a cationic bleaching system provides multi-functional benefits in machine dishwashing applications, including dishware fading and corrosion prevention, glass appearance-enhancing and cleaning efficacy on tea stains.

EXAMPLE 1

TAED as Bleach Activator

| | TAED | PC2 polymer | Glass Appearance | | Residual tea |
|---|---|---|---|---|---|
| Expt No. | Wt % [a] | Wt % [a] | spotting | filming | score |
| 1 | 2.4 | 0.0 | 4.0 | 0.5 | 0.8 |
| 2 | 2.4 | 5.0 | 0.4 | 1.1 | 3.3 |
| 3 | 3.6 | 5.0 | 0.5 | 1.0 | 2.4 |
| 4 | 4.8 | 5.0 | 0.5 | 1.0 | 2.3 |
| 5 | 7.2 | 5.0 | 0.3 | 0.9 | 1.3 |

[a] Wt % is calculated based on weight percentage of the ingredient in the base formulation.

The use of both TAED and PC2 polymer gives improved glass appearance, but at the expense of tea stain removal. This tea stain removal deficiency cannot be overcome even when the amount of TAED was increased three (3) times.

EXAMPLE 2

SNOBS as Bleach Activator

| Expt No. | SNOBS Wt % [a] | PC2 polymer Wt % [a] | Glass Appearance spotting | Glass Appearance filming | Residual tea score |
|---|---|---|---|---|---|
| 1 | 2.4 | 0.0 | 3.2 | 0.5 | 0.5 |
| 2 | 2.4 | 5.0 | 0.2 | 1.0 | 3.7 |
| 3 | 4.8 | 5.0 | 0.5 | 1.0 | 3.6 |
| 4 | 7.2 | 5.0 | 0.8 | 0.9 | 1.1 |

[a] Wt % is calculated based on weight percentage of the ingredient in the base formulation.

SNOBS suffers the same problem as TAED. The use of both SNOBS and PC2 polymer provides improved glass appearance, but at the expense of tea stain removal. This tea stain removal deficiency cannot be overcome even when the amount of SNOBS was increased three (3) times.

EXAMPLE 3

P-15 as Bleach Activator

| Expt No. | P-15 Wt % [a] | PC2 polymer Wt % [a] | Glass Appearance spotting | Glass Appearance filming | Residual tea score |
|---|---|---|---|---|---|
| 1 | 2.4 | 0.0 | 4.0 | 0.3 | 0.9 |
| 2 | 2.4 | 5.0 | 0.8 | 1.0 | 3.1 |
| 3 | 4.8 | 5.0 | 0.5 | 1.0 | 2.7 |
| 4 | 7.2 | 5.0 | 1.0 | 0.9 | 0.2 |

[a] Wt % is calculated based on weight percentage of the ingredient in the base formulation.

Similarly, the use of PC2 polymer in P-15 (benzoyloxybenzene sulfonate) bleaching system provides improved glass appearance, but at the expense of tea stain removal. This tea stain removal deficiency cannot be overcome even when the amount of P-15 was doubled, but was improved when level of P-15 was increased three (3) times.

EXAMPLE 4

Cationic Nitrile as Bleach Activator

| Bleach Activator | Bleach Activator Wt % [a] | PC2 polymer Wt % [a] | Glass Appearance spotting | Glass Appearance filming | Residual tea score |
|---|---|---|---|---|---|
| TAED | 2.4 | 0.0 | 4.0 | 0.5 | 0.8 |
| | 2.4 | 5.0 | 0.6 | 0.9 | 3.4 |
| Cationic Nitrile | 2.4 | 0.0 | 4.0 | 0.5 | 0.0 |
| | 2.4 | 5.0 | 0.4 | 0.8 | 0.0 |
| | 1.2 | 0.0 | 3.8 | 0.8 | 0.4 |
| | 1.2 | 5.0 | 0.8 | 1.0 | 1.2 |

[a] Wt % is calculated based on weight percentage of the ingredient in the base formulation.

Glass appearance was noticeably improved with PC2 polymer in both TAED/perborate and cationic nitrile/perborate systems. However, as disclosed in Example 1, tea stain removal was negatively affected by the addition of PC2 polymer. Contrarily, no negative effect was found on tea stain removal in the cationic nitrile/perborate bleaching system containing PC2 polymer. Further, even when cationic nitrile was reduced to a half weight percent of TAED level, the result was a relatively small increase in residual tea score.

EXAMPLE 5

Imine Quat as Bleach Activator

| Bleach System | Imine Quat Wt % [a] | PC2 polymer Wt % [a] | Glass Appearance spotting | Glass Appearance filming | Residual tea score |
|---|---|---|---|---|---|
| TAED/PB [c] | 0.44 [b] | 0.0 | 3.4 | 0.3 | 0.7 |
| | 0.44 [b] | 5.0 | 0.6 | 1.0 | 3.5 |
| KMPS/PB [d] | 0.44 [b] | 0.0 | 3.7 | 0.3 | 0.1 |
| | 0.44 [b] | 5.0 | 0.5 | 1.0 | 0.6 |
| KMPS [e] | 0.44 [b] | 0.0 | 3.9 | 0.4 | 0.1 |
| | 0.44 [b] | 5.0 | 0.3 | 0.9 | 0.9 |
| KMPS [f] | 0.44 [b] | 0.0 | 3.9 | 0.4 | 0.0 |
| | 0.44 [b] | 5.0 | 0.9 | 0.7 | 0.1 |

[a] Wt % is calculated based on weight percentage of the ingredient in the base formulation.
[b] Giving a final concentration of 50 $\mu$M in the wash liquor.
[c] TAED was dosed at 2.4 wt % and sodium perborate was dosed at 9.0 wt % (51 ppm a.o.).
[d] KMPS was dosed at 10 wt % (20 ppm a.o.) and sodium perborate was dosed at 9.0 wt % (51 ppm a.o.).
[e] KMPS was dosed at 10 wt % (20 ppm a.o.). No perborate was used.
[f] KMPS was dosed at 15 wt % (30 ppm a.o.). No perborate was used.

In this example, imine quat was used as bleach catalyst and was dosed at a concentration of 50 $\mu$M in each test. As can be seen from the table above, with the combination of PC2 with KMPS-containing bleaching system, the negative effect on tea stain removal is significantly reduced compared to that of TAED-containing system. Without being bound by theory, it is believed that KMPS/imine quat can more efficiently generate the cationically charged oxaziridinium compound than TAED/perborate/imine quat system.

As a main theme of the present disclosure, this cationic bleaching species can mitigate the tea stain removal negative caused by the use of an amphoteric polymer (e.g. PC2 Polymer).

EXAMPLE 6

CSPC as Bleach Activator

| Bleach Activator | Bleach Activator Wt % [a] | PC2 polymer Wt % [a] | Glass Appearance spotting | Glass Appearance filming | Residual tea score |
|---|---|---|---|---|---|
| TAED | 2.4 | 0.0 | 4.0 | 0.5 | 0.8 |
| | 2.4 | 5.0 | 0.6 | 0.9 | 3.4 |
| CSPC | 1.2 | 0.0 | 3.8 | 0.2 | 0.0 |
| | 1.2 | 5.0 | 0.6 | 0.9 | 3.0 |
| | 1.8 | 5.0 | 0.8 | 0.8 | 0.0 |
| | 2.4 | 5.0 | 0.1 | 1.5 | 0.0 |

[a] Wt % is calculated based on weight percentage of the ingredient in the base formulation.

This Example illustrates the effect of a cationic group-containing peroxyacid bleach activator, CSPC. At the equal wt % of TAED (2.4%), CSPC/perborate system gives rise to completely cleaned tea cups and improved glass appearance in the presence of PC2 polymer. CSPC can be reduced to 1.8% and still maintain the bleaching performance on tea stain removal. The lowest dosage for CSPC to provide tea stain removal benefit in this base formulation (Table B) in the presence of 5% PC2 Polymer is between 1.2% to 1.8%.

EXAMPLE 7

Manganese-Containing Bleach Catalyst

| Bleach Activator | Bleach Activator Wt % [a] | PC2 polymer Wt % [a] | Glass Appearance spotting | Glass Appearance filming | Residual tea score |
|---|---|---|---|---|---|
| TAED | 2.4 | 0.0 | 4.0 | 0.5 | 0.8 |
| | 2.4 | 5.0 | 0.6 | 0.9 | 3.4 |
| Mn Bleach Catalyst [b] | 0.072 [c] | 0.0 | 3.1 | 1.0 | 0.6 |
| | 0.072 [c] | 5.0 | 1.0 | 1.1 | 0.0 |
| | 0.036 [d] | 0.0 | 3.8 | 0.5 | 0.4 |
| | 0.036 [d] | 5.0 | 0.9 | 1.1 | 0.6 |

[a] Wt % is calculated based on weight percentage of the ingredient in the base formulation.
[b] The manganese-containing bleach catalyst has the following chemical formula: $[Mn^{IV}_2(\mu\text{-}O)_3—(Me_3TACN)_2](PF_6)_2$, where $Me_3TACN$ is 1,4,7-trimethyl-1,4,7-triazacyclononane.
[c] Giving a final catalyst concentration of 3.2 $\mu$M in the wash liquor.
[d] Giving a final catalyst concentration of 1.6 $\mu$M in the wash liquor.

In this example, the levels of manganese-containing bleach catalyst are chosen to give an almost equal performance on tea stain removal achieved by an otherwise identical formulation containing 2.4wt % of TAED. As can be seen in the above Table, combination of manganese-containing bleach catalyst and PC2 polymer preserves the improved glass appearance benefit without the negative effect on tea stain removal.

EXAMPLE 8

Iron-Containing Bleach Catalyst

| Bleach Activator | Bleach Activator Wt % [a] | PC2 polymer Wt % [a] | Glass Appearance spotting | Glass Appearance filming | Residual tea score |
|---|---|---|---|---|---|
| TAED | 2.4 | 0.0 | 4.0 | 0.5 | 0.8 |
| | 2.4 | 5.0 | 0.6 | 0.9 | 3.4 |
| Fe Bleach Catalyst [b] | 0.055 [c] | 0.0 | 4.0 | 0.1 | 0.0 |
| | 0.055 [c] | 5.0 | 2.2 | 1.0 | 0.1 |
| | 0.028 [d] | 0.0 | 3.8 | 0.7 | 0.6 |
| | 0.028 [d] | 5.0 | 0.9 | 1.0 | 1.6 |

[a] Wt % is calculated based on weight percentage of the ingredient in the base formulation.
[b] The iron-containing bleach catalyst has the following chemical formula: $[Fe^{II}(MeN4py)(MeCN)](ClO_4)_2$, where MeN4py is N,N-bis(pyridin-2-yl-methyl)-bis(pyridin-2-yl)-1-ethylamine.
[c] Giving a final catalyst concentration of 3.0 $\mu$M in the wash liquor.
[d] Giving a final catalyst concentration of 1.5 $\mu$M in the wash liquor.

The iron catalyst can be dosed at a 3.0 $\mu$M level to provide excellent tea stain bleaching benefit. Addition of PC2 polymer provides improvement of glass appearance without negative effect on tea stain removal. When the concentration of the iron catalyst is further decreased to a half of the initial dosage, the iron catalyst gives a similar tea stain removal performance similar to that of a bleaching system containing 2.4wt % of TAED. However, with regard to the addition of PC2 polymer the tea stain removal performance is much less affected in the iron catalyst-containing bleach system than that of TAED system.

EXAMPLE 9

Cobalt-Containing Bleach Catalyst

| Bleach Activator | Bleach Activator Wt % [a] | PC2 polymer Wt % [a] | Glass Appearance spotting | Glass Appearance filming | Residual tea score |
|---|---|---|---|---|---|
| TAED | 2.4 | 0.0 | 4.0 | 0.5 | 0.8 |
| | 2.4 | 5.0 | 0.6 | 0.9 | 3.4 |
| Co Bleach Catalyst [b] | 0.089 [c] | 0.0 | 3.8 | 0.6 | 2.1 |
| | 0.089 [c] | 5.0 | 2.1 | 0.9 | 2.5 |
| | 0.18 [d] | 0.0 | 4.0 | 0.3 | 0.9 |
| | 0.18 [d] | 5.0 | 1.5 | 0.9 | 2.4 |
| | 0.36 [e] | 0.0 | 4.0 | 0.5 | 1.3 |
| | 0.36 [e] | 5.0 | 0.7 | 1.2 | 1.8 |

[a] Wt % is calculated based on weight percentage of the ingredient in the base formulation.
[b] The cobalt-containing bleach catalyst has the following chemical formula: $[Co^{III}(NH_3)_5(OAc)]\text{-}(OAc)_2$, where OAc is an acetate anion.
[c] Giving a final catalyst concentration of 10 $\mu$M in the wash liquor.
[d] Giving a final catalyst concentration of 20 $\mu$M in the wash liquor.
[e] Giving a final catalyst concentration of 40 $\mu$M in the wash liquor.

Cobalt-containing bleach catalyst is not as efficient as other transition metal-containing catalyst, such as manganese and iron (see previous Examples) on a per-molar basis. Nevertheless, the reduction on the tea stain removal negative is noted compared to TAED bleaching system. The minimal concentration of the cobalt catalyst required to match the tea stain removal performance of TAED/perborate system is around 20 $\mu$M. It is noted that the negative effect on tea stain removal caused by PC2 polymer is about 1 unit smaller with the cobalt bleaching system than that containing TAED. Further increasing the concentration of cobalt catalyst to 40 $\mu$M in the wash liquor, the negative influence of PC2 polymer on tea stain removal becomes minimal.

EXAMPLE 10

Cationic Polymer and Cationic Bleach

This Example illustrates the effect of a cationic polymer (e.g. Celquat H-100 polymer) against tea stain removal. Celquat H-100 polymer is a cationically modified hydroxyethylcellulose and is commercially available from National Starch and Chemical Company.

| Bleach Activator | Bleach Activator Wt % [a] | Celquat H-100 Wt % [a] | Glass Appearance spotting | Glass Appearance filming | Residual tea score |
|---|---|---|---|---|---|
| TAED | 2.4 | 0.0 | 4.0 | 0.5 | 0.8 |
| | 2.4 | 2.5 | 3.1 | 0.5 | 2.3 |
| | 2.4 | 5.0 | 1.9 | 0.5 | 2.9 |
| | 4.8 | 5.0 | 2.1 | 0.4 | 1.8 |
| Cationic Nitrile | 1.2 | 0.0 | 3.8 | 0.8 | 0.4 |
| | 1.2 | 5.0 | 2.3 | 0.4 | 1.3 |
| | 2.4 | 0.0 | 4.0 | 0.5 | 0.0 |
| | 2.4 | 5.0 | 2.3 | 0.5 | 0.0 |
| Mn Bleach Catalyst [b] | 0.036 [c] | 0.0 | 3.8 | 0.5 | 0.4 |
| | 0.036 [c] | 5.0 | 1.9 | 0.3 | 1.4 |
| | 0.072 [d] | 0.0 | 3.9 | 0.1 | 0.0 |

-continued

| Bleach Activator | Bleach Activator Wt % [a] | Celquat H-100 Wt % [a] | Glass Appearance spotting | Glass Appearance filming | Residual tea score |
|---|---|---|---|---|---|
| | 0.072 [d] | 5.0 | 2.0 | 0.2 | 1.6 |
| | 0.14 [e] | 5.0 | 2.7 | 0.4 | 0.3 |

[a] Wt % is calculated based on weight percentage of the ingredient in the base formulation.
[b] The manganese-containing bleach catalyst has the following chemical formula: $[Mn^{IV}_2(\mu\text{-}O)_3—(Me_3TACN)_2](PF_6)_2$, where $Me_3TACN$ is 1,4,7-trimethyl-1,4,7-triazacyclononane.
[c] Giving a final catalyst concentration of 1.6 $\mu$M in the wash liquor.
[d] Giving a final catalyst concentration of 3.2 $\mu$M in the wash liquor.
[e] Giving a final catalyst concentration of 6.4 $\mu$M in the wash liquor.

As demonstrated in the above Table, cationic polymer (Celquat H-100) negatively affects tea stain bleaching performance, most noticeably in a TAED/perborate bleaching system. Even when the amount of cationic polymer is reduced to a half or the level of bleach activator (i.e. TAED) is increased twice, the resulting tea stain removal performance is still worse than that of a bleaching system using cationic bleach, for example cationic nitrile or manganese containing bleach catalyst.

EXAMPLE 11

Glass Care-Enhancing Polymer and Cationic Bleach

Example 11 illustrates the effect of a glass care-enhancing polymer, Merquat 3331, against tea stain removal. The care enhancing properties of Merquat 3331, including dishware fading and corrosion prevention, are described by Tartakovsky et al. in U.S. Pat. No. 5,981,456. Merquat 3331 polymer (INCI designation: Polyquaternium-39) is an amphoteric terpolymer consisting of 17% acrylic acid, 45% dimethyl diallyl ammonium chloride (DMDAAC) and 38% acrylamide, and is commercially available from Calgon Corporation.

| Bleach Activator | Bleach Activator Wt % [a] | Merquat 3331 Wt % [a] | Glass Appearance spotting | Glass Appearance filming | Residual tea score |
|---|---|---|---|---|---|
| TAED | 2.4 | 0.0 | 4.0 | 0.5 | 0.8 |
| | 2.4 | 1.5 | 0.8 | 1.4 | 3.1 |
| | 2.4 | 2.5 | 0.8 | 2.0 | 2.8 |
| | 2.4 | 5.0 | 1.0 | 1.5 | 2.1 |
| Mn Bleach | 0.072 [c] | 0.0 | 3.9 | 0.1 | 0.0 |
| Catalyst [b] | 0.072 [c] | 1.5 | 0.3 | 2.1 | 0.4 |
| CSPC | 0.3 | 0.0 | 3.2 | 0.4 | 1.8 |
| | 0.6 | 0.0 | 3.3 | 1.0 | 0.3 |
| | 0.6 | 5.0 | 1.6 | 0.8 | 1.2 |
| | 1.2 | 0.0 | 3.8 | 0.2 | 0.0 |
| | 1.2 | 5.0 | 2.8 | 0.5 | 0.1 |
| | 2.4 | 0.0 | 3.8 | 0.5 | 0.0 |
| | 2.4 | 5.0 | 0.4 | 1.0 | 0.0 |

[a] Wt % is calculated based on weight percentage of the ingredient in the base formulation.
[b] The manganese-containing bleach catalyst has the following chemical formula: $[Mn^{IV}_2(\mu\text{-}O)_3—(Me_3TACN)_2](PF_6)_2$, where $Me_3TACN$ is 1,4,7-trimethyl-1,4,7-triazacyclononane
[c] Giving a final catalyst concentration of 3.2 $\mu$M in the wash liquor.

As shown in the above Table, the care-enhancing polymer (Merquat 3331) negatively affects tea stain bleaching performance in a TAED/perborate bleaching system. Interestingly, when the amount of the polymer is reduced from 5% to 1.5% of total composition, the resulting tea stain removal performance is worsened, while the despotting benefit on glasses maintained.

Similar to previous examples, the combination of a bleaching system using cationic bleach, for example, CSPC or manganese-containing bleach catalyst, and Merquat 3331, provides the multifunctional benefits of dishware care, glass appearance-enhancing and cleaning efficacy on tea stains.

Therefore, the above examples show that the combination of a polymer having a cationic charge (cationic or amphoteric) with a bleach activator that also has a cationic charge results in a solution to the problem of removing bleachable stains.

A particular advantage of the above-disclosed formulations is that the need to regenerate internal water softeners and or the use of separate rinse aids can be reduced or eliminated. This would be perceived as a benefit to the consumer due to simplification of the machine dishwashing process. As such, kits containing the disclosed formulations can include printed instructions on the packaging or other enclosure stating that no rinse aid is to be added to the dishwashing machine.

All component percentages are based on weight, unless otherwise indicated. All numerical values are considered to be modified by the term "about" and should be given the broadest available range of equivalents when construing the claims.

Although the illustrative embodiments of the present disclosure have been described herein, it is to be understood that the disclosure is not limited to those precise embodiments, and that various other changes and modifications may be affected therein by one skilled in the art without departing from the scope or spirit of the disclosure.

What is claimed is:

1. A method of removing bleachable-stains from dishware in a machine dishwashing process, the method comprising:

a) providing a detergent composition comprising a bleach system having at least one cationic group and a polymer having at least one monomer unit having a cationic charge over a portion of the pH range 2–11, said polymer having properties for reducing spotting and filming on glassware or glass care enhancing properties, or both;

b) providing dishware in a machine dishwasher, said dishware including articles stained with bleachable stains; and c) contacting said dishware with said detergent composition in a machine dishwashing process;

wherein said composition provides tea stain removal performance that is better than the performance of an otherwise identical composition that has a non-cationic group containing bleach substituted for the cationic group containing bleach.

2. A machine dishwashing detergent composition comprising:

a) an amphoteric or cationic polymer, the polymer delivering glass spotting and filming benefits or glass care enhancing benefits or both in a machine dishwashing process; and b) a bleach system having at least one cationic group, wherein the combination of a) and b) provides tea stain removal performance that is better than the performance of an otherwise identical composition that has a non-cationic group containing bleach substituted for the cationic bleach.

3. A composition according to claim 2, wherein the polymer is present at a level from about 0.1 to about 20 wt % of the total weight of composition.

4. A composition according to claim 2, wherein the bleach system comprises a bleach activator, a bleach catalyst or combination thereof.

5. A composition according to claim 4, wherein the bleach system is present at a level of from about 0.01 to about 10 wt. % of the total composition.

6. The formulation according to claim 2, wherein the polymer is an amphoteric polymer.

7. The composition according to claim 6, wherein the polymer is a water-soluble polymer containing as polymerized units, a) from about 92 to about 30 percent by weight of one or more $C_3$–$C_6$ monoethylenically unsaturated carboxylic acids;

b) from about 5 to about 50 percent by weight of one or more quaternized aminoacryloyl derivatives; and c) from about 0 to about 25 percent by weight of one or more monoethylenically unsaturated monomers polymerizable with (a) and (b).

8. The composition according to claim 2, wherein the polymer is a cationic polymer.

9. The composition according to claim 8, wherein the polymer is a cationically modified hydroxyethylcellulose.

10. The composition according to claim 2, wherein the amphoteric or cationic polymer contains a diallyldimethylammonium salt as polymerized units.

11. The composition according to claim 2, wherein the amphoteric or cationic polymers are selected from the group consisting of Polyquaternium-4, Polyquaternium-22, Polyquaternium-24, Polyquaternium-39, and Polyquaernium-47.

12. The composition according to claim 2, wherein the cationic group containing bleach is selected from the group of organic cationic bleach activators or bleach catalysts consisting of: cationic nitriles; cationic peroxyacid bleach precursors; quaternary imine salts; and mixtures thereof.

13. The composition according to claim 2, wherein the bleach activators or bleach catalysts are selected from the group consisting of:

cyanomethyl trimethylammonium methylsulfate; cholyl (4-sulphophenyl)carbonate; N-methyl-3-,4-dihydroisoquinolinium p-toluenesulfonate and mixtures thereof.

14. The composition according to claim 2, wherein the cationic group containing bleach is selected from the group of transition metal bleach catalysts consisting of:

$[Mn^{IV}{}_2(\mu\text{-}O)_3(Me_3TACN)_2](PF_6)_2$; $[Fe^{II}(MeN4py)(MeCN)](ClO_4)_2$; and $[Co^{III}(NH_3)_5(Oac)](Oac)_2$; and mixtures thereof.

15. A kit comprising:

a) a detergent composition as set forth in claim 2; and b) an enclosure for a), said enclosure including printed instructions stating that no rinse aid is to be added to the dishwashing machine.

* * * * *